US005689235A

United States Patent [19]

Sugimoto et al.

[11] Patent Number: 5,689,235

[45] Date of Patent: Nov. 18, 1997

[54] ELECTRONIC SECURITY SYSTEM

[75] Inventors: Tadashi Sugimoto; Masahiko Shibata; Yoshihiro Imuro, all of Otsu, Japan

[73] Assignee: Optex Co., Ltd., Shiga, Japan

[21] Appl. No.: 626,416

[22] Filed: Apr. 2, 1996

[51] Int. Cl.[6] ..... G08B 13/00

[52] U.S. Cl. ..... 340/541; 340/531; 379/40; 379/44

[58] Field of Search ..... 340/541, 567, 340/506, 528, 531, 538, 692, 825.5, 825.51, 825.34; 379/37, 40, 44, 51

[56] References Cited

U.S. PATENT DOCUMENTS

| | | | |
|---|---|---|---|
| 3,906,491 | 9/1975 | Gosswiller et al. | 340/692 X |
| 3,990,075 | 11/1976 | Schmitz et al. | 379/40 X |
| 4,107,464 | 8/1978 | Lynch et al. | 340/692 X |
| 4,703,312 | 10/1987 | Berry, III | 340/692 X |
| 4,851,823 | 7/1989 | Mori | 340/692 X |
| 5,400,011 | 3/1995 | Sutton | 340/692 X |
| 5,552,766 | 9/1996 | Lee et al. | 340/541 |

*Primary Examiner*—Thomas Mullen

*Attorney, Agent, or Firm*—Hamilton, Brook, Smith & Reynolds, P.C.

[57] ABSTRACT

An electronic security system includes a detector (S1, S2) for detecting unauthorized entry of a trespasser into a predetermined outdoor area (A1) or an indoor area (A2) and for generating a detection signal (d1 or d2) indicative of the entry of the trespasser. A mode setting circuit (2) is operated by an input keying operation to select one of an alert mode, in which any possible entry into the predetermined outdoor area (A1) or the indoor area (A2) is monitored, and a non-alert mode in which the possible entry into the predetermined outdoor area (A1) or the indoor area (A2) is not monitored. A control unit (4) preferentially transmits a warning through a telephone line (1) when it receives the detection signal (d1 or d2) generated during the alert mode, but transmits no warning during the non-alert mode. A warning device (12) acknowledges dispatch of the warning. A priority selector (8) is used and operates when the warning is preferentially transmitted to the telephone line (L) for switching from the preferential transmission of the warning over to a normal telephone communication by means of an input keying operation performed by an operator informed of the warning.

6 Claims, 2 Drawing Sheets

ELECTRONIC SECURITY SYSTEM

BACKGROUND OF THE INVENTION

1. Field of the Invention

The present invention generally relates to an electronic security system for monitoring an unauthorized entry of a trespasser into a house or an office and, more particularly, to the electronic security system designed to improve the convenience of a user utilizing such electronic security system.

2. Description of the Prior Art

The home security system in general is known comprising a detecting means for detecting unauthorized entry of a trespasser into a predetermined outdoor or indoor area and for generating a detection signal. When the security system is set in an alert mode, the detection signal is transmitted through a telephone line to a monitor station provided in a security center such as, for example, a security company to inform the security center that the unauthorized entry of a trespasser has occured within the private property for which the security center is responsible. This known home seciruty system is such that when the detection signal is generated while the security system is set in a non-alert mode, no warning is issued on the account that a house within the private property is currently occupied by dwellers of a user.

It has, however, been found that the known home security system has the following problem. By way of example, in the event that the detecting means detects the presence of the user while the user has failed to switch from the alert mode over to the non-alert mode, the warning is transmitted to the monitor station through the telephone line. If such misinformation is transmitted to the monitor station as a result of an erroneous operation done by the user, the user cannot advise the security center by telephone that the warning dispatched is based on the misinformation. This is because with the known home security system the telephone line is preferentially used for the home security system. Accordingly, because of the telephone line unable to be utilized as described above, communication to the security center is more or less delayed and security countermeasures such as dispatch of security guard men and/or communication to a police station tend to be taken unnecessarily.

SUMMARY OF THE INVENTION

The present invention has been devised to substantially eliminate the above discussed problems inherent in the prior art electronic security system and is intended to provide an improved electronic security system capable of permitting the user to communicate to the security center immediately in the event that misinformation as a result of the user's erroneous operation is transmitted to the monitor station, thereby improving the user's convenience.

In order to accomplish the foregoing object, the present invention according to a broad aspect thereof provides a security system which comprises a detecting means for detecting entry of a trespasser into a predetermined outdoor area or an indoor area and for generating a detection signal indicative of the entry of the trespasser; a mode setting means operable by an input operation to select one of an alert mode, in which any possible entry into the predetermined outdoor area or the indoor area is monitored, and a non-alert mode in which the possible entry into the predetermined outdoor area or the indoor area is not monitored; a control means for preferentially transmitting a warning through a telephone line upon receipt of the detection signal generated during the alert mode and for transmitting no warning during the non-alert mode; a warning means for acknowledging dispatch of the warning; and priority selector means operable when the warning is preferentially transmitted to the telephone line for switching from the preferential transmission of the warning over to a normal telephone communication by means of an input operation performed by an operator informed of the warning.

According to another aspect of the present invention, there is provided a security system which comprises a first detecting means for detecting entry of a trespasser into a predetermined outdoor area and for generating a first detection signal indicative of the entry of the trespasser into the predetermined outdoor area; a second detecting means for detecting entry of a trespasser into an indoor area and for generating a second detection signal indicative of the entry of the trespasser into the indoor area; a mode setting means operable by an input operation to select one of a vacant alert mode, in which any possible entry into any one of the predetermined outdoor area and the indoor area is monitored, an in-house alert mode, in which any possible entry into the predetermined outdoor area is monitored, and a non-alert mode in which the possible entry into any one of the predetermined outdoor area and the indoor area is not monitored; a control means for preferentially transmitting a warning through a telephone line upon receipt of one of the first and second detection signals generated during the vacant alert mode or upon receipt of the first detection signal generated during the in-house alert mode, and for transmitting no warning during the non-alert mode; a warning means for acknowledging dispatch of the warning; and a priority selector means operable when the warning is preferentially transmitted to the telephone line for switching from the preferential transmission of the warning over to a normal telephone communication by means of an input operation performed by an operator informed of the warning.

According to the present invention, the use of the priority selector means is advantageous in that even if the misinformation is dispatched as a result of the user's erroneous operation, preferential transmission of the warning through the telephone line is immediately switched over to normal communication so that the dispatch of the misinformation can readily and quickly be informed by telephone communication. Therefore, the erroneous operation done by the user can be covered up, thereby enhancing the user's convenience.

Preferably, the control means transmits the warning preferentially to a monitor station of a security center responsible for security observation based on the warning. Accordingly, security countermeasures can be taken quickly.

Also preferably, the electronic security system may further comprise an alert means for causing the warning means to acknowledge that the system has been set in the in-house mode in the event that the second detection signal is outputted from the second detecting means after a first predetermined time subsequent to the security system having been set in the in-house alert mode.

Where the alert means referred to above is employed, where the user is not aware that the security system has been set in the in-house alert mode, the possibility of the misinformation being dispatched can be avoided by calling the user to attention that the security system has been set in the in-house alert mode, that is, the warning will be issued if the user steps out from the indoor area to the outdoor area.

Moreover, the electronic security system of the present invention may further comprise an alarm release means for releasing the in-house alert mode and establishing the non-alert mode in the event that during the in-house alert mode the second detection signal is outputted from the second detecting means and the first detection signal is subsequently outputted from the first detecting means within a second predetermined time after the outputting of the second detection signal, said alarm release means being capable of causing the warning means to acknowledge that the in-house alert mode has been released.

Where the alarm release means referred to above is employed, it is determined that the security system need not be set in the in-house alert mode in the event that the user is found within the predetermined outdoor area within the second predetermined time after he or she has been detected within the indoor area during the in-house alert mode, and therefore the in-house alert mode can be automatically switched over to the non-alert mode, thereby avoiding dispatch of the misinformation. At the same time, the user can recognize this automatic switching over to the non-alert the mode.

BRIEF DESCRIPTION OF THE DRAWINGS

In any event, the present invention will become more clearly understood from the following description of a preferred embodiment thereof, when taken in conjunction with the accompanying drawings. However, the embodiment and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENT

Figure 1:
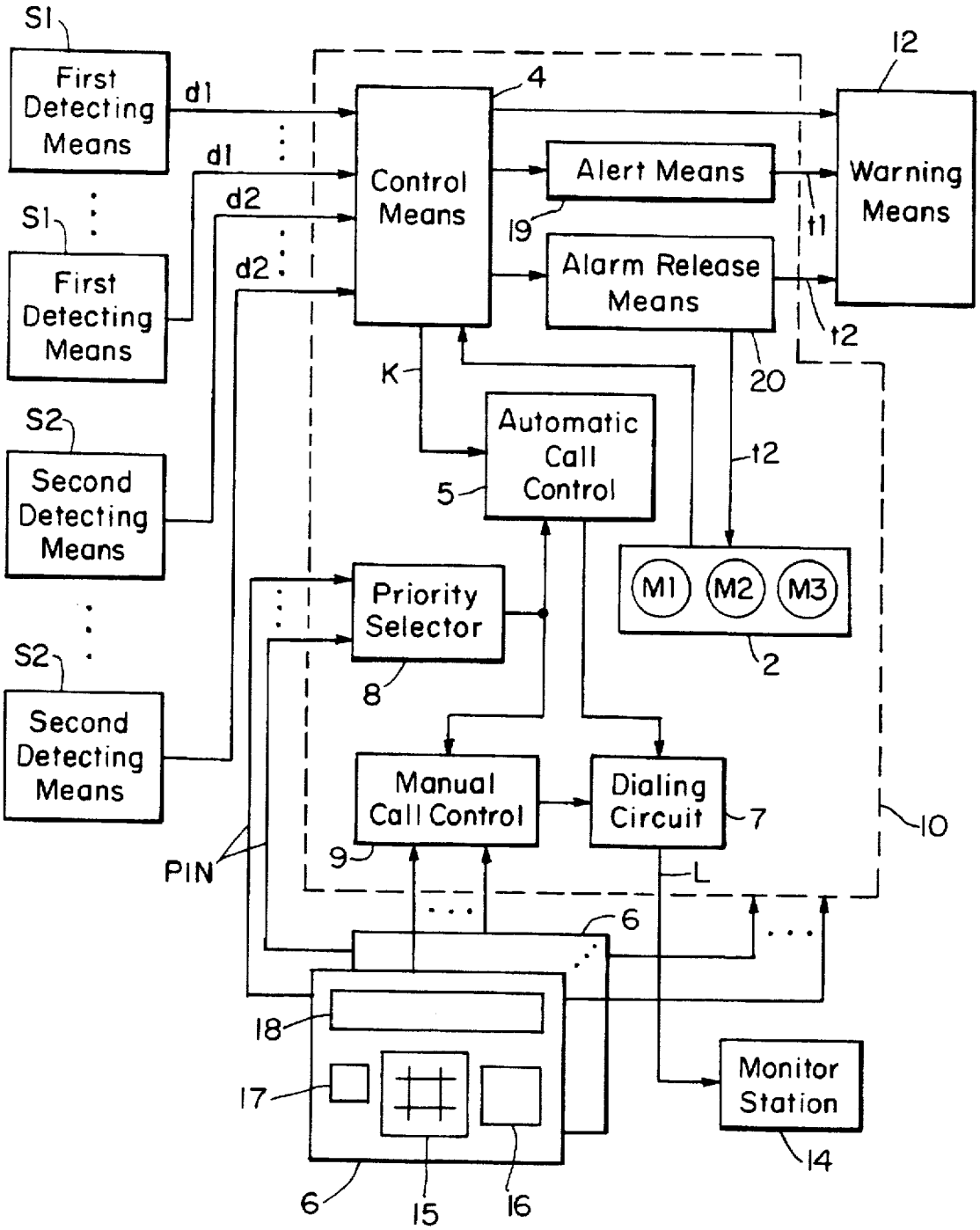
FIG. 1 is a block circuit diagram showing a security system according to a preferred embodiment of the present invention.

Referring now to FIG. 1 showing in a block circuit representation a security system embodying the present invention, the security system shown therein comprises a plurality of first detecting means S1 installed outdoors, a plurality of second detecting means S2 installed indoors, a control panel 10 including a mode setting means 2, a control means 4, an automatic call control means 5, a dialing circuit 7, a priority selector means 8, a manual call control means 9, an alert means 19 and an alarm release means 20, a plurality of input/output devices 6 each including a numerical input keyboard 15, a telephone set 16, a voice means 17 and a display means 18, and a plurality of warning means 12. The control panel 10 is connected by means of a telephone line L with a monitor station 14 such as, for example, a security center of a security company so that a warning signal can be transmitted through the telephone line L.

Figure 2:
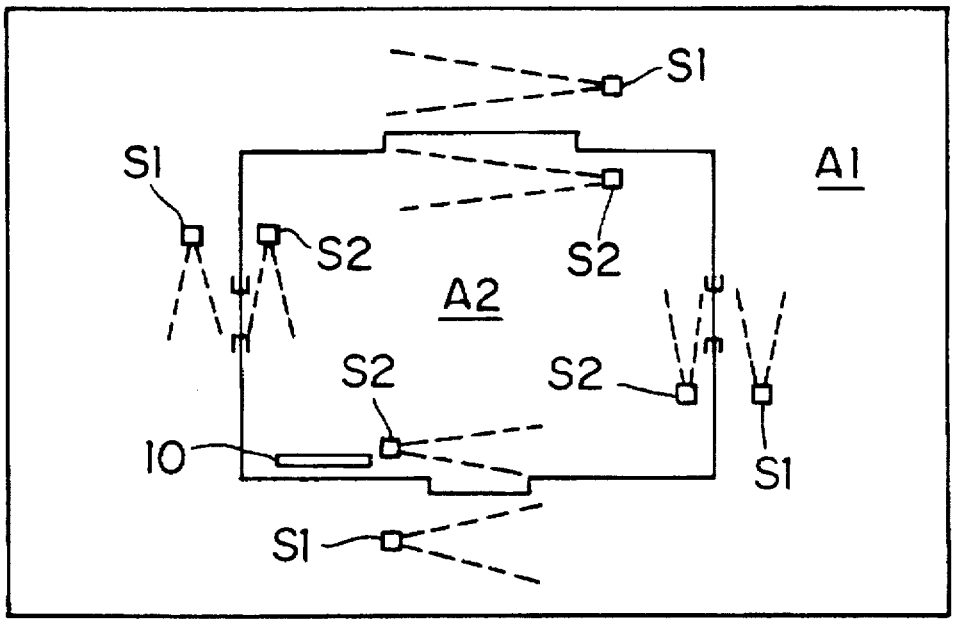
FIG. 2 is a schematic plan view showing an arrangement of first and second detecting means employed in the security system of the present invention.

As shown in FIG. 2, the first detecting means S1 are installed at a corresponding number of outdoor installations within a predetermined outdoor area A1 of a private property so that any one of the first detecting means S1 can output a first detection signal d1 when it detects a trespasser entering the outdoor area A1. For this purpose, these first detecting means S1 may be secured to and supported by, for example, poles installed within the outdoor area A1 of the private property, a fence surrounding the house, doors and/or windows of the house. On the other hand, the second detecting means S2 are installed at a corresponding number of locations inside an indoor area A2 so that any one of the second detecting means S2 can output a second detection signal d2 when it detects a trespasser entering the indoor area A2. For this purpose, these second detecting means S2 may be secured to and supported by terraces, doors and/or windows of the house. Both of the first and second detecting means S1 and S2 are activated at all times so that regardless of whether it is a trespasser or whether it is a dweller a human body can be detected. For each of those first and second detecting means S1 and S2, a passive infrared (PIR) sensor, a microwave sensor or an infrared beam sensor may be employed. Where some or all of the first detecting means S1 are used to detect selective opening or closure of windows and/or doors, a magnet switch may be employed for those first detecting means S1.

Figure 3:
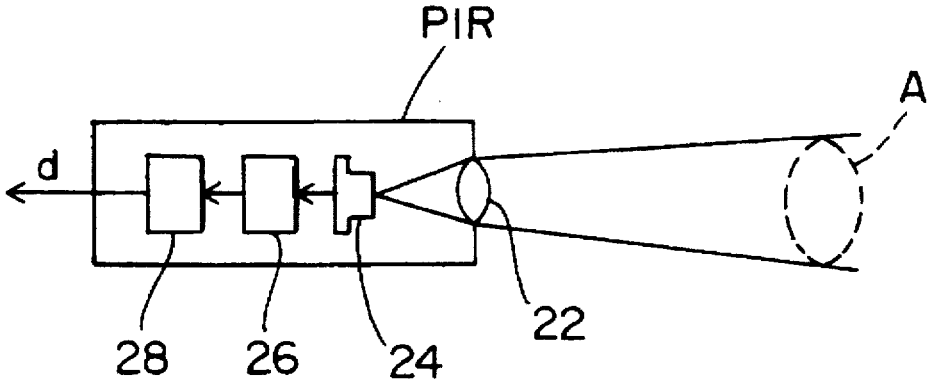
FIG. 3 is a schematic diagram showing one example of the detecting means which can be employed in the practice of the present invention.

By way of example, a passive infrared sensor mainly used for the second detecting means S2 may be of a type including, as shown in FIG. 3, a light receiving lens 22 that defines a predetermined detection area A within a space to be monitored, an infrared detecting element 24 such as, for example, a pyroelectric element, a thermistor bolometer or the like for receiving infrared energies radiated from the detection area A and collected by the light receiving lens 22 and for converting the incident infrared energies into an electric signal proportional to the amount of change of the incident infrared energies. Change in amount of the infrared energies radiated from the detection area A is monitored at all times in terms of the level of the electric signal outputted from the infrared detecting element 24. When someone enters the detection area A defined by the angle of coverage of the light receiving lens 22, the amount of infrared energies incident upon the infrared detecting element 24 through the light receiving lens 22 undergoes a change by a quantity of infrared energies radiated from the human body relative to the amount of infrared energies radiated from the background within the detection area A. In reference to the change in amount of the infrared energies, a determining circuit 26 detects the presence of the human body, that is, a trespasser, within the detection area A and an output circuit 28 outputs a detection signal indicative of the presence of the trespasser within the detection area A.

Referring back to FIG. 1, the control panel 10 shown therein may be installed at a location within the indoor area A2, for example, at an indoor wall or a desk in the vicinity of a door. The various component parts of the control panel 10 will now be described individually.

The mode setting means 2 has a plurality of operating modes that can be chosen when the user manipulates the numerical input keyboard 15 of the input/output device 6 to input one of modes M1 to M3 together with a predetermined code number (PIN). It is to be noted that although in the illustrated embodiment the code number is keyed in to the control panel 10, a card input system may be employed to supply information to the control panel 10 by inserting a card.

A vacant alert mode M1 is a mode during which entry into the predetermined outdoor area A1 and the indoor area A2 is watched and is chosen when all of the dwellers of the user's house are out of the house leaving the house vacant. A in-house alert mode M2 is a mode during which entry into the predetermined outdoor area A1 is watched and is chosen when the dwellers of the house have got to bed. A non-alert mode M3 is a mode during which entry into any of the predetermined outdoor area A and the indoor area A2 is not watched and is chosen when at least one of the dwellers of the house is at home doing daily routine works.

The control means 4 control the security system in its entirety in such a manner as to supply an alarm enabling signal k to the automatic call control means 5 when the first detection signal d1 from the first detecting means S1 or the second detection signal d2 from the second detecting means S2 is supplied thereto during the vacant alert mode M1 or when the first detection signal d1 from the first detecting means S1 is supplied thereto during the in-house alert mode M2, as to provide predetermined information to the warning means 12 which may be of a type capable of generating an alarm or an artificial voice, and as to exercise other functions. It is to be noted that no warning is issued even when the control means 4 receives any one of the first and second detection signals d1 and d2 during the non-alert mode M3.

The automatic call control means 5 is operable in response to the alarm enabling signal k to immediately supply the dialing circuit 7 with a dialing signal descriptive of a telephone number of the monitor station 14. The dialing circuit 7 operates in response to this dialing signal to dial the telephone dial number of the monitor station 14. When the telephone line L is connected with the telephone set in the monitor station 14 as a result of the dialing performed by the dialing circuit 7, alert information indicative of the presence of a trespasser entering the predetermined outdoor area A1 or the indoor area A2 is automatically supplied to the monitor station 14.

The priority selector means 8 performs a priority switching from the automatic call control means 5 over to the manual call control means 9 when the user manipulates the numerical input keyboard 15 of the input/output device 6 to enter the code number (PIN). When the manual call control means 9 is so activated, the automatic call is inhibited to thereby interrupt transmission of the alert information. In this way, when the priority is switched over to the manual call control means 9, a dialing signal descriptive of a telephone dial number of the monitor station 14 which is manually inputted from the numerical input keyboard 15 of the input/output device 6 by the user is supplied to the dialing circuit 7 so that the dialing circuit 7 can dial the telephone dial number of the monitor station 14 to connect the telephone line L. When the telephone line L is so connected with the telephone set in the monitor station 14, the user can speak to the telephone set 16 to inform the monitor station 14 of dispatch of a false report or misinformation.

The alert means 19 outputs an alert signal t1 to the warning means 12 in the event that after the lapse of a first predetermined time subsequent to the in-house alert mode M2 having been selected, the second detecting means 2 outputs the second detection signal d2, to trigger the warning means 12 to generate an alarm (chime) or an announcement descriptive of the in-house alert mode M2 having been selected. It is to be noted that the first predetermined time referred to above and hereinafter is determined in consideration of the length of time generally required for the dweller, who has set the security system in the in-house alert mode M2 in the night, goes to bed so that no alert signal will not be outputted even when the dweller moving within the house during such length of time, that is, the first predetermined time, is detected.

The alarm release means 20 is operable to output an alarm release signal t2 to the mode selector means 2 to forcibly cause to the mode selector means 2 to change from the in-house alert mode M2 over to the non-alert mode M3, in the event that during the in-house alert mode M2 the second detection signal d2 is outputted from the second detecting means S2 and the first detection signal d1 is outputted from the first detecting means S2 within a second predetermined time subsequent to the outputting of the second detection signal d2 from the second detecting means S2. In such case, the control means 4 does not issue the alarm. The alarm release signal t2 is supplied to the warning means 12 to trigger the warning means 12 to generate an alarm (chime) or an announcement descriptive of the in-house alert mode M2 having been released. It is to be noted that the second predetermined time referred to above and hereinafter is determined in consideration with the length of time which the dweller within the indoor area may take to go out to the outdoor area.

The input/output device 6 includes the numerical input keyboard 15 having ten numerical keys, an artificial voice generating means 17 and a display means 18 such as, for example, a liquid crystal display. For this input/output device 6, a plurality of key pads are employed and installed at a corresponding number of locations such as, for example, wails at an entrance hall, a kitchen and some other places in the indoor area A2. This input/output device 6 is assigned to perform input and/or output processing in relation to the control panel 10 and provides a voice guidance and/or an alphanumeric guidance by means of the artificial voice generating means 17 and the display means 18, respectively, so that the user can be taught how to operate the security system and how to deal with the misinformation dispatched by the user.

The numerical input keyboard 15 is utilized to input a series of alphanumerical information descriptive of a code number and that of a telephone dial number. The telephone set 16 is utilized by the user to exchange a communication in the event of dispatch of the misinformation.

The warning means 12 are optionally disposed at a plurality of outdoor locations to issue a warning signal to the dwellers of the house. By way of example, for each of the warning means 12, a loudspeaker and/or a lamp may be used. Once the warning signal is issued, an announcement of issue of an alarm or a warning signal is made through the loudspeaker and/or the lamp is lighted. It is to be noted that the voice means 17 and/or the display means 18, both included in each of the input/output devices 6 may also be activated to issue a warning signal simultaneously with issue of the announcement from the loudspeaker and/or lighting of the lamp.

The security system of the construction described hereinbefore operates in the following manner.

(1) When No One is in the House:

In the case where all of the dwellers in the user's house are out of the house, the user should manipulate the numerical input keyboard 15 of any one of the input/output device 6 to input both of the code number (PIN) and the alert mode M1 and, as a result thereof, the mode setting means 2 sets the security system in the vacant alert mode M1. When during this vacant alert mode M1, the first or second detecting means S1 or S2 detects a trespasser entering the outdoor or indoor area A1 or A2, the control means 4 activates the dialing circuit 7 to transmit a warning signal to the monitor station 14 through the telephone line L. At the same time, the warning means 12 issues the warning alarm and/or announcement, accompanied by lighting of the outdoor lamps.

It is to be noted that, once the warning signal is issued, arrangement may be made so that a portable telephone or a pager carded by the user then being out of the house can be activated to inform the user of entry of an unauthorized trespasser into the user's private property.

(2) When the User is in the House:

When the user returns home from where he or she had been, the user is advised by the alarm or announcement from the warning means 12 that within a predetermined time subsequent to his or her return the vacant alert mode M1 should be switched over to the in-house alert mode M2 or the non-alert mode M3. When so advised, the user should manipulate the keyboard of any one of the input/output devices 6 to input one of the in-house and non-alert modes M2 and M3 together with the code number (PIN) within the predetermined time to accomplish the requisite change. Should the user be unable to accomplish this mode switching within the predetermined time for some reason, or in the event that after one of the dwellers in the user's house has set the security system in the in-house alert mode M2 another one of the dwellers in the user's house leaves the house to the outdoor area A without knowing that the security system has been set in the in-house alert mode M2, the detection signal d1 or d2 triggers the warning to be dispatched. Such a dispatch of the misinformation as a result of the user's erroneous manipulation can be recognized by the user when the warning means 12 generates the alarm or announcement indicative of the warning.

Once this misinformation is issued as a result of the user's erroneous operation, the user should follow the operating procedure called for by the voice means 17 and/or displayed by the display means 18 to input the code number (PIN) through the numerical input keyboard 15. With this code number so inputted in this way, the priority selector means 8 is activated to preferentially switch from the automatic call control means 5, then activated, over to the manual call control means 9. When the manual call control means 9 is so switched on, the telephone dial number inputted through the numerical input keyboard 15 is straightforwardly supplied to the dialing circuit 7. Accordingly, by inputting the telephone dial number through the numerical input keyboard 15, the user can speak to the telephone set 16. When the telephone line L is connected in this way, the user can inform the monitor station 14 of the dispatch of the misinformation. Upon completion of communication with the monitor station 14, the automatic call control means 5 is automatically resumed a predetermined time after the completion of the communication with the monitor station 14.

Thus, since even if the misinformation is dispatched as a result of the user's erroneous operation, preferential transmission of the warning to the telephone line L is immediately switched over to normal communication so that the monitor station can readily and quickly be informed of the dispatch of the misinformation, the erroneous operation done by the user can be covered up, thereby enhancing the user's convenience.

(3) When the Dwellers go to Bed in the Night:

When the dwellers go to bed in the night, the security system is set in the in-house alert mode M2. In other words, when the first detecting means S1 detects the presence of a trespasser entering the predetermined outdoor area A1, the warning can be dispatched to the monitor station 14, but even when the second detecting means S2 detects the presence of any one of the dwellers within the indoor area A2, no warning is dispatched.

However, if while the security system is set in the in-house alert mode M2 the user himself or herself forgets that he or she has set the security system in the in-house alert mode M2 or any one of the dwellers including the user is not certain whether the security system has been set in the in-house alert mode M2, the warning will be issued the moment the user goes out of the indoor area A2 into the outdoor area A1.

In such case, according to the present invention, when the second detecting means S2 detects the presence of the dweller in the indoor area A2 the first predetermined time after the security system has been set in the in-house mode, the alert means 19 outputs the alert signal t1 to the warning means 12 to cause the latter to generate an alarm (chime) and/or announcement to inform that the security system is set in the in-house alert mode M2. Accordingly, where the user is not aware that the security system has been set in the in-house alert mode M2, the possibility of the misinformation being dispatched can be avoided by calling the user to attention that the security system has been set in the in-house alert mode M2, that is, the warning will be issued if the user steps out from the indoor area A2 to the outdoor area A1.

Furthermore, in the event that the second detecting means S2 having detected the presence of the dweller within the indoor area A2 issues the second detection signal d2 and, within the second predetermined time, for example, 1 minutes, the first detecting means S1 detects the presence of the dweller within the predetermined outdoor area A1 and therefore issues the first detection signal d1, the alarm release means 20 outputs the alarm release signal t2 to the mode setting means 2 to forcibly release the in-house alert mode M2 to thereby switch over to the non-alert mode M3. Simultaneously therewith, the alarm release means 20 supplies the alarm release signal t2 to the warning means 12 to cause the latter to issue an alarm (chime) and/or announcement to inform that the alarm has been released. In such case, the control means 4 controls the warning means 12 not to issue any warning. Accordingly, even when the user fails to switch the in-house alert mode M2 over to the non-alert mode M3 while the security system need not be set in the in-house alert mode M2 such as occurring, for example, when early in the morning of the following day the user goes out of the indoor area A2 into the outdoor area A1 to, for example, receive newspapers, the non-alert mode M3 can be automatically resumed and the user can recognize this automatic switching of the mode.

In describing the preferred embodiment of the present invention, reference has been made to the security system having the three modes, that is, the vacant alert mode M1, the in-house alert mode M2 and the non-alert mode M3, the security system of the present invention may work satisfactorily even though only two modes, that is, an alert mode for monitoring entry into the indoor or outdoor area and a non-alert mode, are employed.

In addition, although the security system of the present invention has been shown and described as employed in association with the private house, it can be equally employed in association with an office building.

Although the present invention has been fully described in connection with the preferred embodiment thereof with reference to the accompanying drawings which are used only for the purpose of illustration, those skilled in the art will readily conceive numerous changes and modifications within the framework of obviousness upon the reading of the specification herein presented of the present invention. By way of example, in place of the numerical input keyboard 15 in each of the input/output devices 6, a speech input means may be employed so that the input operation can be accomplished by speech.

Accordingly, such changes and modifications are, unless they depart from the scope of the present invention as delivered from the claims annexed hereto, to be construed as included therein.

What is claimed is:

1. A security system which comprises:

detecting means for detecting entry of a trespasser into a predetermined outdoor area or an indoor area and for generating a detection signal indicative of the entry of the trespasser;

mode setting means operable by an input operation to select one of an alert mode, in which any possible entry into the predetermined outdoor area or the indoor area is monitored, and a non-alert mode in which the possible entry into the predetermined outdoor area or the indoor area is not monitored;

control means for preferentially transmitting a warning through a telephone line upon receipt of the detection signal generated during the alert mode and for transmitting no warning during the non-alert mode;

warning means for acknowledging dispatch of the warning; and priority selector means operable when the warning is preferentially transmitted to the telephone line for switching from the preferential transmission of the warning over to a normal telephone communication by means of an input operation performed by an operator informed of the warning.

2. The security system as claimed in claim 1, wherein said control means transmits the warning preferentially to a monitor station of a security center responsible for security observation based on the warning.

3. A security system which comprises:

a first detecting means for detecting entry of a trespasser into a predetermined outdoor area and for generating a first detection signal indicative of the entry of the trespasser into the predetermined outdoor area;

a second detecting means for detecting entry of a trespasser into an indoor area and for generating a second detection signal indicative of the entry of the trespasser into the indoor area;

mode setting means operable by an input operation to select one of a vacant alert mode, in which any possible entry into any one of the predetermined outdoor area and the indoor area is monitored, an in-house alert mode, in which any possible entry into the predetermined outdoor area is monitored, and a non-alert mode in which the possible entry into any one of the predetermined outdoor area and the indoor area is not monitored;

control means for preferentially transmitting a warning through a telephone line upon receipt of one of the first and second detection signals generated during the vacant alert mode or upon receipt of the first detection signal generated during the in-house alert mode, and for transmitting no warning during the non-alert mode;

warning means for acknowledging dispatch of the warning; and priority selector means operable when the warning is preferentially transmitted to the telephone line for switching from the preferential transmission of the warning over to a normal telephone communication by means of an input operation performed by an operator informed of the warning.

4. The security system as claimed in claim 3, wherein said control means transmits the warning preferentially to a monitor station of a security center responsible for security observation based on the warning.

5. The security system as claimed in claim 3, further comprising an alert means for causing the warning means to acknowledge that the security system has been set in the in-house mode in the event that the second detection signal is outputted from the second detecting means after a lapse of a first predetermined time subsequent to the security system having been set in the in-house alert mode.

6. The security system as claimed in claim 5, further comprising an alarm release means for releasing the in-house alert mode and establishing the non-alert mode in the event that during the in-house alert mode the second detection signal is outputted from the second detecting means and the first detection signal is subsequently outputted from the first detecting means within a second predetermined time after the outputting of the second detection signal, said alarm release means being capable of causing the warning means to acknowledge that the in-house alert mode has been released.

* * * * *